United States Patent [19]

Vaalburg

[11] 3,982,302

[45] Sept. 28, 1976

[54] WEB FORMING APPARATUS AND METHOD

[75] Inventor: Lawrence Vaalburg, Brookhaven, Pa.

[73] Assignee: Scott Paper Company, Philadelphia, Pa.

[22] Filed: Apr. 10, 1975

[21] Appl. No.: 566,970

[52] U.S. Cl. ..... 19/156.3

[51] Int. Cl.[2] ..... D01G 25/00

[58] Field of Search ..... 19/155, 156–156.4, 19/88, 89, 145.5; 156/62.2, 62.4; 425/80, 81, 82

[56] References Cited

UNITED STATES PATENTS

| | | | |
|---|---|---|---|
| 1,284,922 | 12/1918 | O'Connell | 19/89 |
| 2,086,592 | 7/1937 | Williams | 19/145.5 X |
| 3,797,074 | 3/1974 | Zafiroglu | 19/156.3 |

FOREIGN PATENTS OR APPLICATIONS

| | | | |
|---|---|---|---|
| 197,488 | 5/1923 | United Kingdom | 19/89 |

*Primary Examiner*—Dorsey Newton

*Attorney, Agent, or Firm*—Martin L. Faigus; William J. Foley

[57] ABSTRACT

Web forming apparatus of this invention includes a fiberizing roll for separating fibers from a feed mat and entraining them in a gaseous medium, a foraminous forming surface through which the gaseous medium passes and upon which the fibers are condensed to form a fibrous web and a formation duct having an upstream end adjacent the fiberizing roll and a downstream end adjacent the forming surface, whereby the formation duct defines a flow path for the gaseous suspension of fibers from the fiberizing roll to the forming surface; the improvement including passageways at opposite sides of the apparatus adjacent the upstream end of the formation duct for communicating the duct with an atmosphere having a lower pressure than that within the duct for removing air to eliminate the adverse effect of vortices which are created by rotation of the fiberizing roll. A method of forming a fibrous web by employing the above-described apparatus also forms a part of this invention.

12 Claims, 3 Drawing Figures

WEB FORMING APPARATUS AND METHOD

BACKGROUND OF THE INVENTION

1. Field of the Invention

This invention relates to method and apparatus for forming fibrous webs from a gaseous suspension of fibers, and more specifically to an improvement in such method and apparatus for achieving formation of fibrous webs having high quality edges.

2. Description of the Prior Art

Air-laid fibrous webs are becoming extremely popular for single, or limited use products, such as disposable diapers, sanitary napkins, cosmetic pads, industrial towels, household towels, tissues and the like.

A commonly employed apparatus for forming an air-laid fibrous web includes a fiberizing roll for separating fibers from a fibrous feed mat and entraining the fibers in air to form an air suspension of said fibers. The air suspension of fibers is directed through an upstream end of a formation duct toward a moving foraminous forming surface which traverses a downstream open end of said duct. The air from the suspension is directed through the foraminous forming surface, and the fibers from the suspension are condensed upon the surface to form the air-laid fibrous web. A partial vacuum is established behind the forming surface to aid in directing the air suspension of fibers toward it. Quite often the formed webs are subjected to conventional post-treatment operations; such as embossing, adhesive bonding and the like; to impart desired properties to the webs.

Uniformity of web formation is enhanced by providing substantially uniform flow of the gaseous suspension of fibers from the fiberizing roll to the forming surface. Uniform flow is enhanced by establishing a low depth ratio between the upstream end of the formation duct and the location at which fibers are diverted from the fiberizing roll toward said formation duct in a direction which is substantially tangent to the outer periphery of said fiberizing roll. This latter location is approximately where the outer periphery of the fiberizing roll most closely approaches an extended section of the bottom wall of the formation duct. The above-described depth ratio will hereinafter be referred to as "D.R.".

Although the uniformity in basis weight of the major portion of the web has been improved by reducing the D.R., the longitudinal edges of the web have been unacceptably nonuniform in basis weight. Accordingly, it has been necessary to sever these edges from the main body of the web in order to produce acceptable nonwoven products from said web. Although the removed edges can be reprocessed, the required removal of these edges renders the web forming operation less efficient than would be the case if the edges were sufficiently uniform in basis weight so that they could be retained in the web during subsequent processing of said web into nonwoven products.

U.S. Pat. No. 3,797,074, issued to Zafiroglu, discloses an air-laydown apparatus and method in which a partial vacuum is established through a lower duct surface upstream of a fiberizing roll for removing any turbulent boundary layer which might develop. To achieve this objective the vacuum is established over the entire cross-machine-direction dimension of the duct. The arrangement disclosed in the Zafiroglu patent is not effective in removing standing vortices in a fiber laden gas stream downstream of a fiberizing roll created by the high speed rotation of said fiberizing roll. In fact, the Zafiroglu patent is concerned with an entirely different problem than that which applicant has discovered and solved. Specifically, Zafiroglu is concerned with the removal of low velocity air flow which occurs at air-confining boundaries over which the flow is directed.

SUMMARY OF THE INVENTION

Forming apparatus of this invention includes a fiberizing roll for separating fibers from a feed mat, web or lap, and entraining them in a gaseous medium, a foraminous forming surface through which the gaseous medium passes and upon which the fibers are condensed to form a fibrous web and a formation duct having an upstream end adjacent the fiberizing roll and a downstream end adjacent the forming surface, whereby said formation duct defines a flow path for the gaseous suspension of fibers from said fiberizing roll to said forming surface; the improvement including passageways at opposite sides of the apparatus adjacent the upstream end of the formation duct for communicating the duct with an atmosphere having a lower pressure than that within the duct. This pressure drop removes air from the duct to eliminate the adverse effect of vortices which are created by rotation of the fiberizing roll. Preferably, the formation duct is at about atmospheric pressure during operation of the apparatus, and a vacuum means communicates with each passageway for establishing the pressure drop. However, if the formation duct is above atmospheric pressure during operation of the apparatus, a separate vacuum means may not be required.

Applicant has discovered that nonuniform edge formation was created by standing vortices generated by high speed rotation of the fiberizing roll. These vortices where found to exist at side margins of the apparatus adjacent the upstream end of the formation duct. The adverse effect of these vortices has been eliminated, in accordance with this invention, by removing air from upstream side margins of the formation duct as described above. The adverse effect of the standing vortices on edge formation has been found to be most severe at a D.R. of less than about 4.

Other objects and advantages of this invention will become apparent upon reading the detailed description which follows, taken in conjunction with the drawings.

DESCRIPTION OF THE PREFERRED EMBODIMENTS OF THIS INVENTION

Figure 1:
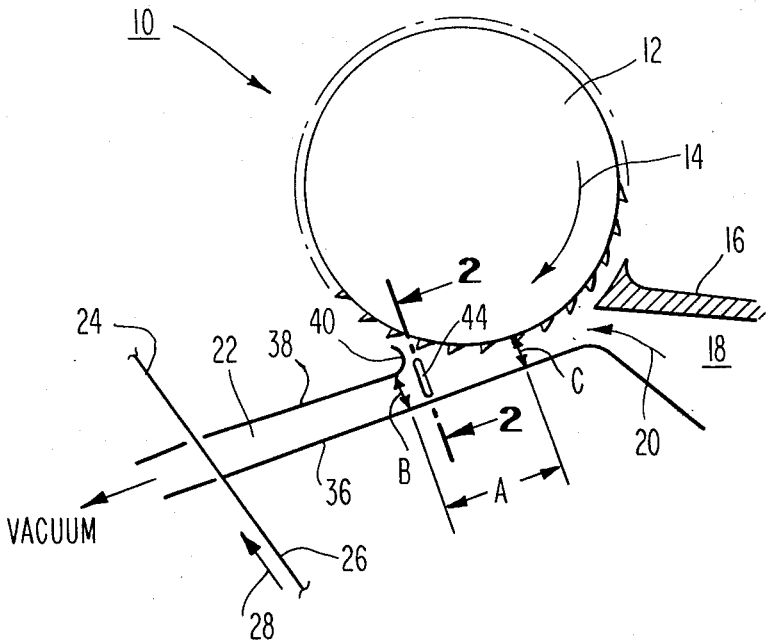
FIG. 1 is a schematic view of a web forming apparatus of this invention.

Referring to FIG. 1, a web forming apparatus 10 of this invention includes a fiberizing roll 12 which is positively driven by any suitable drive means (not shown) in the direction indicated by arrow 14. The fiberizing roll 12 includes pins or teeth on the outer surface thereof. In a preferred embodiment of this invention the fiberizing roll 12 is a conventional lickerin roll of the type employed in the "Rando-Webber", manufactured by Rando Machine Corporation of Rochester, New York. A fibrous feed mat (not shown) is directed over a supporting surface 16 into engagement with the rotating fiberizing roll 12. The fibers are separated from the feed mat by the fiberizing roll and are suspended in an air stream which enters the fiberizing zone through an air inlet duct 18 in the direction indicated by arrow 20. If desired, the high pressure side of a fan (not shown) can be connected to the air inlet duct 18 for directing the air into the fiberizing zone. The air-suspended stream of fibers is directed through a formation duct 22 toward a outer foraminous forming surface 24 of a forming wire 26. The forming wire 26 is positively driven in the direction of arrow 28 by any suitable drive means (not shown).

Movement of the air-suspended stream of fibers toward the foraminous forming surface 24 is enhanced by establishing a partial vacuum from beneath the foraminous surface 24 in underlying relationship with the open downstream end of the formation duct 22. The partial vacuum is established by a fan (not shown), and can be employed to draw air into the air inlet duct 18.

The nonwoven webs formed in accordance with this invention can be of any desired fiber composition. For example, the webs can be formed of 100% short cellulosic fibers of a papermaking length less than ¼ inch, 100% longer staplelength fibers, or blends of such short and longer fibers. Also, the basis weight of such webs can be varied over a wide range.

In accordance with a preferred form of this invention nonwoven webs having a low basis weight in the range of from about 1 oz./yd.$^2$ to about 6 oz./yd.$^2$ are formed from a fiber blend comprising a preponderance, by weight, of short cellulosic fibers of a papermaking length less than ¼ inch (e.g. wood pulp fibers and cotton linters) and a minor amount of longer reinforcing fibers (e.g. rayon and polyester). A nonwoven web as described above can be formed by any conventional processing sequence; a preferred sequence being disclosed in U.S. Pat. No. 3,862,472, titled "Method for Forming a Low Basis Weight Non-Woven Fibrous Web", issued on Jan. 28, 1975, and assigned to Scott Paper Company. The subject matter of that application is incorporated by reference into the instant application.

Figure 3:
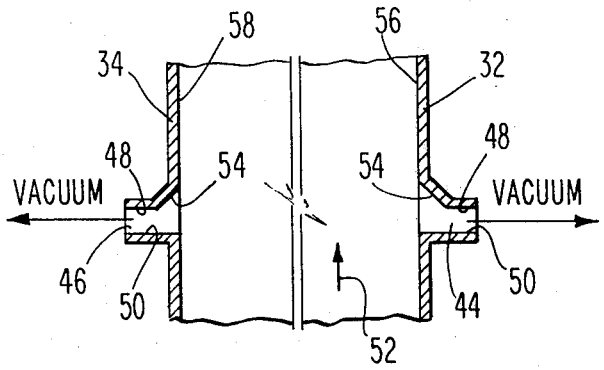
FIG. 3 is a sectional view taken along line 3—3 of FIG. 2.
Figure 2:
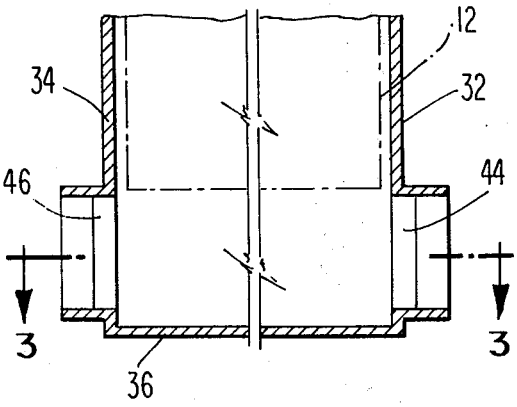
FIG. 2 is a sectional view taken generally along line 2—2 of FIG. 1.

Referring to FIGS. 1–3, the apparatus 10 includes a diffusing section "A" disposed upstream of the formation duct 22. This diffusing section is defined between side plates 32 and 34, the outer surface of the fiberizing roll 12 and a back plate 36. A front plate 38 cooperates with the back plate 36 and side plates 32 and 34 to provide the formation duct 22 which is disposed immediately downstream of the diffusing section "A". The upstream end of the front plate includes a doffing edge 40 in close proximity to the fiberizing roll 12. Preferably the D.R. (B/C in FIG. 1) is less than 4, and more preferably less than 2, to aid in establishing uniform flow of the air-fiber mix through the apparatus 10. The problem of establishing uniform flow is most prevalent at high formation speeds in excess of 200 feet/minute.

Applicant has discovered that webs formed by the apparatus 10, as described thus far, have extremely nonuniform edges. Applicant has discovered that this poor edge formation has resulted from the creation of standing vortices by high speed rotation of the fiberizing roll. Applicant has encountered an edge formation problem at a fiberizing roll surface speed of about 8,000 feet/minute; however, this problem may be significant at lower surface speeds. Applicant discovered that the vortices are created adjacent the sides of the apparatus at the downstream end of the diffusing section "A" (i.e. adjacent the upstream end of the formation duct 22). It was further discovered that air should be removed from areas containing standing vortices to eliminate the adverse effect of the vortices on edge formation quality.

Referring again to FIGS. 1–3, passageways 44 and 46 extend through side plates 32 and 34, respectively, adjacent the upstream end of the formation duct 22. Most preferably these passageways are disposed at the junction between the diffusing section "A" and the upstream end of the formation duct 22. Preferably, the formation duct is at about atmospheric pressure during operation of the apparatus 10, and a source of vacuum, such as a fan (not shown), is connected to each of the passageways 44 and 46 for establishing a pressure drop through them to thereby remove air from the duct to eliminate the adverse effect of the vortices on edge formation quality. Applicant has been found that this removal of air greatly enhanced the edge quality in the nonwoven webs.

Referring specifically to FIG. 3, each of the passageways 44 and 46 includes spaced apart side surfaces 48 and 50. Arrow 52 indicates the downstream direction of fiber flow through the formation duct past these passageways. The downstream side surface 48 of each passageway preferably includes an inclined section 54 which diverges from opposed side surface 48 in a direction toward a respective inner, longitudinally extending surface 56 and 58 of the side plates 32 and 34, respectively. This inclination has been found to be important in preventing fibers from building up on edges of the passageways. Such a build up of fibers would block the passageways to thereby prevent the removal of the vortices. To further explain, if the downstream side surface 48 of each of the passageways 44 and 46 formed a substantially right angle corner with the inner longitudinal surface of its respective side plate 32 and 34, fibers would become stapled across the corner, and thereby block the opening through the passageways. By providing an inclined section 54 fibers which are diverted slightly into the passageways by the vacuum will hit the flat inclined sections and ricochet back into the duct rather than hang up on the edges of the passageways. Accordingly, the inclusion of the inclined section 52 in each of the passageways prevents the build up of fibers across the open end of each passageway to thereby eliminate machine down time which would otherwise be required to free the passageways from fibers stapled across the open end thereof. Although inclined sections 52 are employed in the most preferred embodiment of the invention, other edge configurations can be employed to prevent the stapling of fibers thereon.

The preferred embodiments of this invention employ passageways extending through side plates of the apparatus; however, it is within the scope of this invention to include such passageways in the back plate, in a region closely adjacent to each side plate. In the preferred embodiment of this invention the partial vacuum established through each passageway is in the range of from about 2–25 inches of water, and is applied to pull about 50 cubic feet per minute of air through each passageway. This vacuum level has been effective in eliminating the adverse effect of the vortices without removing a significant quantity of fibers from the apparatus (i.e. less than 1%).

Having described my invention, I claim:

1. An apparatus for forming a fibrous web from a gaseous suspension of fibers, said apparatus including a fiberizing roll for separating fibers from a fibrous feed mat and entraining said fibers in a gaseous medium, a foraminous forming surface through which the gas of said suspension passes and upon which said fibers are condensed to form said fibrous web, a formation duct having an upstream end adjacent the fiberizing roll and and a downstream end adjacent the forming surface for providing a flow path for the gaseous suspension of fibers from said fiberizing roll to said forming surface; the improvement including a pair of passageways adjacent the upstream end of the formation duct, each passageway extending through a formation duct wall and said passageways being located only adjacent opposite side margins of the formation duct, and vacuum means communicating with said passageways for creating a lower pressure outside said duct than inside said duct for removing air from within upstream side margins of said formation duct to eliminate the adverse effect of vortices which are created adjacent said side margins by rotation of the fiberizing roll.

2. The apparatus according to claim 1, wherein said passageways extend through opposed side plates of said apparatus, said passageways including side surfaces which are spaced apart in the direction of material flow through the formation duct, said side surfaces extending through opposed inner and outer surfaces of the side plates, the most downstream side surface of each passageway including an inclined section which diverges from the most upstream side surface in a direction toward the inner surface of said side plate to prevent the stapling of fibers across the opening of each passageway.

3. The apparatus according to claim 1, wherein said formation duct has a depth adjacent its upstream end defined between opposed front and back plates, said apparatus including a bottom wall disposed in spaced, underlying relationship with said fiberizing roll, the ratio of the depth of the duct adjacent its upstream end to the spacing between the fiberizing roll and the underlying bottom wall substantially where the fiberizing roll most closely approaches the bottom wall being less than 4.

4. The apparatus according to claim 1, wherein said formation duct has a depth adjacent its upstream end defined between opposed front and back plates, said apparatus including a bottom wall disposed in spaced, underlying relationship with said fiberizing roll, the ratio of the depth of the duct adjacent its upstream end to the spacing between the fiberizing roll and the underlying bottom wall substantially where the fiberizing roll most closely approaches the bottom wall being less than 2.

5. The apparatus according to claim 2, wherein said formation duct has a depth adjacent its upstream end defined between opposed front and back plates, said apparatus including a bottom wall disposed in spaced, underlying relationship with said fiberizing roll, the ratio of the depth of the duct adjacent its upstream end to the spacing between the fiberizing roll and the underlying bottom wall substantially where the fiberizing roll most closely approaches the bottom wall being less than 4.

6. The apparatus according to claim 2, wherein said formation duct has a depth adjacent its upstream end defined between opposed front and back plates, said apparatus including a bottom wall disposed in spaced, underlying relationship with said fiberizing roll, the ratio of the depth of the duct adjacent its upstream end to the spacing between the fiberizing roll and the underlying bottom wall substantially where the fiberizing roll most closely approaches the bottom wall being less than 2.

7. The apparatus according to claim 1, wherein said passageways extend through opposed side plates of said apparatus.

8. A method for forming a nonwoven fibrous web, said method comprising the steps of:

a. rotating a fiberizing roll for separating fibers from a feed mat and entraining said fibers in a gaseous medium to form a gaseous suspension of fibers;

b. conveying the gaseous suspension of fibers in a downstream direction through a formation duct toward a foraminous forming surface;

c. depositing the fibers from the suspension onto the forming surface to form the nonwoven web; the improvement of;

d. providing a pair of passageways adjacent an upstream end of the formation duct, each passageway extending through a formation duct wall and said passageways being located only adjacent opposite side margins of the formation duct; and e. establishing a pressure drop through said passageways for removing air from upstream side margins of the formation duct to eliminate the adverse effect of vortices which are created by the rotation of the fiberizing roll.

9. The method according to claim 8, wherein the pressure drop is established by positively sucking air through the passageways.

10. The method according to claim 8, including the step of establishing a second pressure drop across the forming surface in underlying relationship with the forming surface for aiding in directing the gaseous suspension of fibers toward said forming surface, said second pressure drop being effective to withdraw the gas of the suspension through the forming surface and to deposit the fibers from the suspension onto said forming surface to form the nonwoven fibrous web.

11. The method according to claim 8, including depositing the fibers onto the forming surface to form a web having a basis weight in the range of from about 1 oz./yd.$^2$ to about 6 oz./yd.$^2$.

12. The method according to claim 11, including forming said web of a blend of short cellulosic fibers less than ¼ inch in length and longer reinforcing fibers.

* * * * *